United States Patent [19]

Meyrat

[11] 4,379,642

[45] Apr. 12, 1983

[54] APPARATUS FOR THE SELECTION OR CORRECTION OF DATA IN AN ELECTRONIC WATCH

[75] Inventor: Clement Meyrat, LeLanderon, Switzerland

[73] Assignee: Ebauches, S.A., Switzerland

[21] Appl. No.: 232,864

[22] Filed: Feb. 9, 1981

[30] Foreign Application Priority Data

Feb. 13, 1980 [CH] Switzerland ..... 1161/80

[51] Int. Cl.[3] ..... G04C 9/00; G04B 29/00

[52] U.S. Cl. ..... 368/188; 368/321

[58] Field of Search ..... 368/69-70, 368/155, 185, 187-188, 319-321; 328/59, 63, 65

[56] References Cited

U.S. PATENT DOCUMENTS 4,336,609 6/1982 Kume et al. ..... 368/188

4,348,753 9/1972 Werner et al. ..... 368/188

FOREIGN PATENT DOCUMENTS 1518769 7/1978 United Kingdom .

2019049 3/1979 United Kingdom .

*Primary Examiner*—Vit W. Miska

*Attorney, Agent, or Firm*—Allegretti, Newitt, Witcoff & McAndrews, Ltd.

[57] ABSTRACT

The apparatus comprises commutating means 10 operated by the rotation in one direction or the other of the watch spindle 1, which rotation produces trains of commutation pulses that are phase-displaced with respect to each other. The watch circuit produces from the trains of commutation pulses a signal indicating the direction of rotation of the spindle and produces selection or correction pulses. The commutating means comprise two cams 2, 3 mechanically coupled to the rotatable spindle 1, angularly displaced one with respect to the other and arranged to actuate two resiliently flexible strips 4, 5 which are fixed at one of their free ends and the other free ends of which are alternately brought into contact with and removed from respective fixed contacts 7, 8. The watch circuit can include means for rendering ineffective a predetermined number of selection pulses at the beginning of the rotation of the spindle in one direction or the other.

7 Claims, 5 Drawing Figures

APPARATUS FOR THE SELECTION OR CORRECTION OF DATA IN AN ELECTRONIC WATCH

BACKGROUND OF THE INVENTION

The invention relates to apparatus for the selection or the correction of data in an electronic watch provided with a rotatable spindle, the apparatus comprising commutation means operated by the rotation of the spindle in one direction or the other and arranged to produce two series of commutation pulses which are phase-displaced with respect to each other, the sign of the phase displacement depending on the direction of rotation of the spindle. In response to the series of commutation pulses, the watch circuit produces a signal indicating the direction of rotation of the spindle and produces selection or correction pulses.

The push buttons with which electronic watches are commonly provided for the selection and correction of data are increasingly being replaced by a more traditional control member, i.e., the rotatable spindle for setting the time indicating by the watch. It is therefore necessary to develop commutation devices which are capable of converting the movements of this spindle into an electronical signals which can be utilized by the electronic circuits of the watch.

In addition, it is useful, in order to reduce the amount of time required for correcting the data, to be able to effect such correction in the backward direction as well as in the forward direction, this being particularly the case with watches provided with analogue display means. This can be achieved in known manner by turning the rotatable spindle in one direction or the other. In this case, the device for effecting the correction must at the same time provide an indication of the direction of rotation.

A known method of simultaneously obtaining pulses for the selection or correction of data and a signal representing the direction of rotation of the spindle consists in using two contacts which are operated so as to produce two series of pulses which are phase-displaced with respect to each other. The present invention is concerned with a simplified apparatus, which is easy to produce and is not too cumbersome, for carrying out this method.

BRIEF SUMMARY OF THE INVENTION

In accordance with the present invention, the selection or correction of data in an electronic watch having a rotatable spindle is achieved by means of novel commutation means operated by the rotation of the spindle in either direction. Such rotation produces two series of commutation pulses which are phase-displaced with respect to each other, the sign of the phase displacement depending on the spindle direction of rotation, and a circuit responsive to the commutation pulses to provide a signal indicating the direction of spindle rotation and producing selection or correction pulses, the commutation means comprising two cams mechanically coupled to the rotatable spindle and angularly displaced relative to each other, and two resiliently flexible strips of electrically conductive material, each of which cooperates with a respective one of the cams and has one fixed end and one free end, the free end of each strip being alternately brought into contact with and moved away from a respectively fixed contact during the rotation of the spindle.

In one preferred embodiment of the invention the cams are of generally elliptical shape, e.g. true ellipse, oval, racetrack shape. The axis of rotation of the spindle extends through the centers of the ellipses and the major axes of the ellipses forming between them a predetermined angle, preferably an angle of approximately 45°.

In addition, it may happen that the spindle is accidentally caused to rotate or that the user, intending to turn it in one direction, begins by mistake to turn it in the opposite direction. In order that the commutation pulses produced during such rotation of the spindle should not produce changes in the data displaced or unintentional corrections of the data, the watch circuit is preferably provided with inhibiting means which render a predetermined number of selection or correction pulses ineffective at the beginning of the rotation of the spindle in one direction or the other.

BRIEF DESCRIPTION OF THE DRAWINGS

A preferred embodiment of the invention will now be described by way of example with reference to the accompanying drawings, in which.

DETAILED DESCRIPTION OF THE PREFERRED EMBODIMENT

Figure 1:
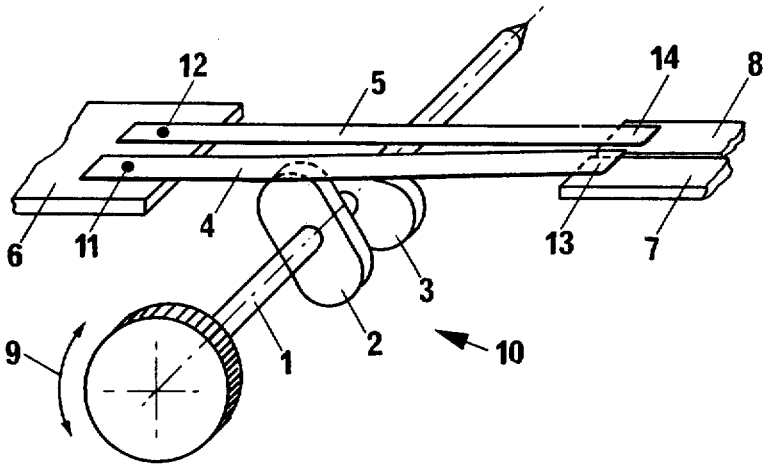
FIG. 1 is a diagrammatic perspective view of one illustrative form of the commutating means for the apparatus according to the invention.

As shown in FIG. 1, a rotatable spindle 1 supported by bearings (not shown) carries two cam 2, 3 of generally elliptical shape, the central axis of the spindle passing through the centers of the ellipses. The major axes of the ellipses are inclined to each other at an angle substantially equal to 45°.

Commutation means 10 include two resiliently flexible contact strips 4, 5 composed of an electrically conductive material. The strips 4, 5 which cooperate respectively with the cams 2, 3, are fixed at their one ends 11, 12 to a part 6 of the frame of the watch. When the spindle 1 is rotated, the free ends 13, 14 of the flexible contact strips 4, 5 are alternately brought into contact with and removed from two fixed contacts 7, 8 which are connected to a circuit for the production of selection or correction pulses. In this embodiment of the invention, each strip 4, 5 is moved away from the corresponding contact 7, 8 twice during each complete revolution of the spindle 1.

Figure 2:
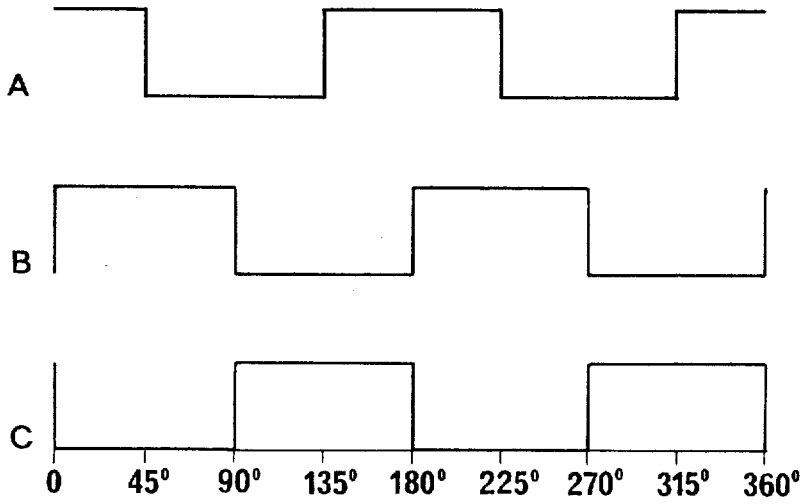
FIG. 2 contains diagrammatic representations of the signals produced by the commutating means of FIG. 1.

FIG. 2 contains diagrammatic representations of the signals produced by the commutation means 10 and circuitry connected therewith while the spindle 1 rotates through 360°. In these diagrammatic representations no account has been taken of parasitical phenomena such as surge currents.

If the signal A is assumed to be that which is produced by the strip 4 and the fixed contact 7 of FIG. 1, the signal B is then that which is produced by the strip 5 and the fixed contact 8 when the spindle 1 is rotated in one direction, while the signal C is that which will be produced by the same contact 8 when the spindle 1 is rotated in the opposite direction.

These signals are rectangular pulses, the frequency of which depends on the speed of rotation of the spindle 1. FIG. 2 also shows that the pulses produced by one of the contacts 7, or 8 are out of phase with the pulses produced by the other contact 8 or 7 by an angle equal to that formed with respect to each other by the major axes of the two cams 2, 3 (FIG. 1), i.e., 45°. The sign of this phase difference depends on the direction of rotation of the spindle 1.

Figure 3:
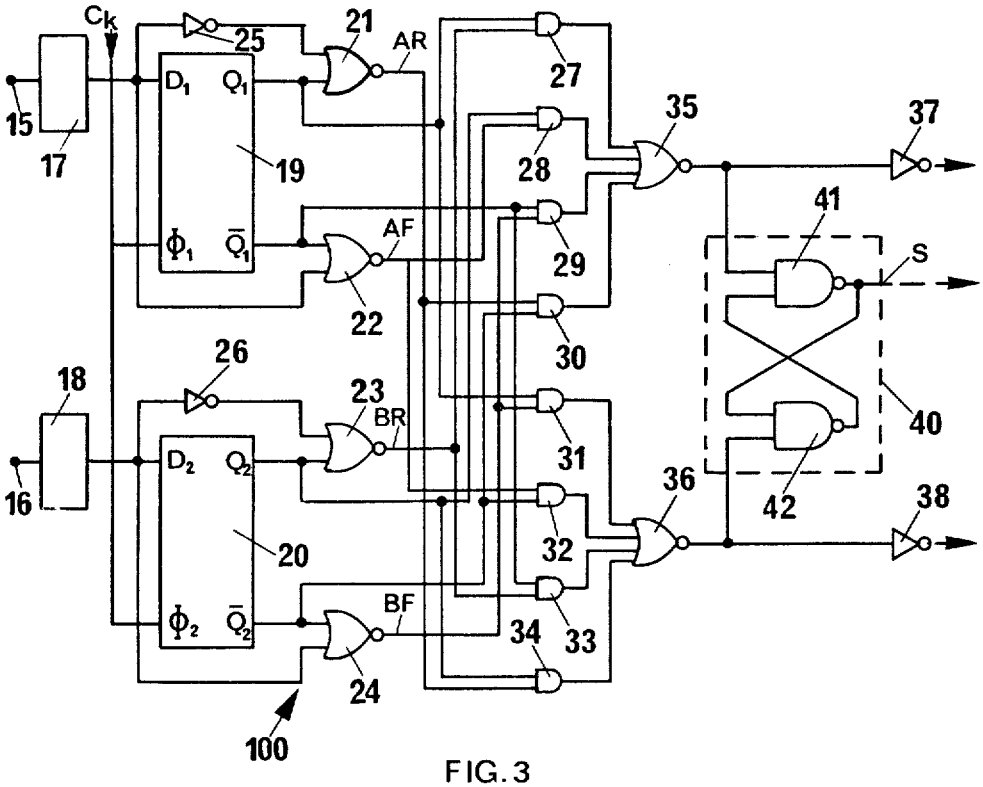
FIG. 3 is an illustrative example of a circuit which enables correction pulses and a signal indicating the direction of rotation of the spindle to be produced.

FIG. 3 shows an example of a circuit 11 for the production of correction or selection pulses and of a signal representing the direction of rotation of the spindle 1 from commutation pulses produced by the means previously described with reference to FIG. 1. Input terminals 15 and 16 of this circuit are electrically connected to the fixed contacts 7, 8 of the commutation means 10. The circuit 100 comprises two D-type flip-flops 19 and 20, the input connections $D_1$ and $D_2$ of which are connected to the input terminals 15 and 16, respectively, via surge-suppression circuits 17 and 18. These flip-flops 19, 20 both receive, via their clock inputs $\phi_1$ and $\phi_2$, the same signal $C_k$ of a predetermined frequency, e.g. 256 Hz, which originates from an intermediate output connection of a frequency divider circuit (not shown) provided in the watch. It is to be noted that, if each of the surge suppression circuits 17, 18 consists in known manner of two D-type flip-flops connected in series, the flip-flops 19 and 20 may be substituted by the second flip-flops of these circuits.

The output $Q_1$ of the flip-flop 19 is connected to one of the two inputs of a NOR gate 21, the other input of which is connected, via an inverter 25, to the output of the surge-suppression circuit 17. This output is also connected to one of the inputs of a second NOR gate 22, the other input of which is connected to the complementary output $\overline{Q}_1$ of the flip-flop 19.

In the same manner the outputs $Q_2$ and $\overline{Q}_2$ of the flip-flop 20 are connected respectively to the first inputs of the NOR gates 23 and 24. The second input of the gate 23 is connected, via an inverter 26, to the output of the surge-suppression circuit 18, while the second input of the gate 24 receives directly the signals emitted by the circuit 18. The circuit 100 also comprises eight AND gates 27 to 24. The inputs of the gate 27 are connected to the output $Q_1$ of the flip-flop 19 and the output of the NOR gate 23, those of the gate 28 to the output $Q_2$ of the flip-flop 20 and the output of the NOR gate 22, those of the gate 29 to the output $\overline{Q}_1$ of the flip-flop 19 and the output of the gate 24, and those the gate 30 to the output $\overline{Q}_2$ of the flip-flop 20 and the output of the gate 21. Likewise the inputs of the gates 31, 32, 33, 34 receive respectively signals emanating from the output $Q_1$ and the gate 24, from the output $\overline{Q}_2$ and the gate 22, from the output $\overline{Q}_1$ and the gate 23 and from the output $Q_2$ and the gate 21.

The outputs of the AND gates 27 to 30 are connected respectively to the four inputs of a NOR gate 35, while the outputs of the AND gates 31 to 34 are connected respectively to the four inputs of a NOR gate 36.

The gates 35 and 36 are followed respectively by inverters 37 and 38 at the outputs of which appear the selection or correction pulses.

The circuit 100 comprises in addition an R-S flip-flop 40 constituted by two NAND gates 41, 42 and the input terminals of which are connected to the outputs of the NOR gates 35, 36.

Figure 4:
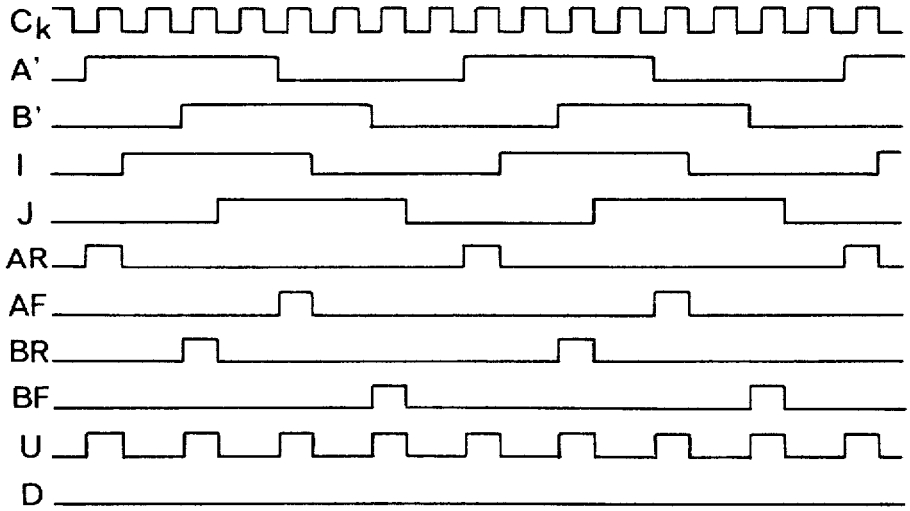
FIG. 4 contains diagrammatic representations of a plurality of signals with a view to illustrating the operation of the circuit of FIG. 4.

The operation of the circuit 100 will now be described with the aid of the diagram of FIG. 4. In these diagrams, the signal A', B' are those which appear at the outputs of the surge-suppression circuits 17 and 18 and which correspond to the pulses transmitted from the commutation means 10 (FIG. 1). The signals I and J are those transmitted from the outputs $Q_1$ and $Q_2$ of the flip-flops 19 and 20, while the signals AR, AF, BR, BF, U and D are those which appear respectively at the outputs of the gates 21, 22, 23 and 24 and of the inverters 37 and 38.

Assuming that the outputs of the circuits 17, 18 are initially in the logical state "0", the same will apply to the outputs $Q_1$ and $Q_2$ of the flip-flops 19 and 20. The outputs of the NOR gates 21 to 24, as well as the outputs of the AND gates 27 to 24, are then in the "0" state. The outputs of the NOR gates 35 and 36 will therefore be in the logical "1" state. The arrival of a commutation pulse at the input $D_1$ causes the output $Q_1$ to change over to the "1" state with a slight delay due to the fact that the output $Q_1$ only changes its state at the end of the first clock pulse $C_k$ following the change of state of the input $D_1$ from "0" to "1". In addition, the change of state of the signals A' from "0" to "1" opens the gate 21 which is reclosed when the output $Q_1$ is changed over to the "1" state. The output of the gate 21 then only remains in the "1" state during the period of time taken by the flip-flip 19 to change its state. So long as the output of the gate 21 is in the "1" state, the AND gate 30 is open, as a result of which the NOR gate 35 is closed. A pulse then appears at the output 9 of the inverter 37. The other AND gate 34, one output of which is connected to the output of the NOR gate 21, remains closed due to the fact that the output $Q_2$ of the flip-flop 20 remains in the "0" state. The output of the gate 36 then remains in the "1" state.

The same result is obtained when the commutation pulse emanating from the surge-suppression device 18 reaches the input $D_2$ of the flip-flop 20. The gates concerned this time are the NOR gate 23 and the AND gate 27 which closed the gate 35 during a period of time equal to the time taken by the flip-flop 20 to change its state. A second pulse then appears at the output of the inverter 37.

At the end of the commutation pulse A' the output $Q_1$ reverts from "1" to the "0" state and the complementary output connection $\overline{Q}_1$ from the "0" state to the "1" state. This time it is the NOR gate 22 which is open during the period of the change of state and which, by the intermediary of the NAD gate 28, closes the gate 35, as a result of which a fresh pulse is caused to appear at the output of the inverter 37. In like manner, a pulse appears at this same output at the end of the commutation pulse emanating from the circuit 18, due this time to the gates 24 to 29. Then, when the spindle 1 rotates in one direction, a series of pulses, represented diagrammatically in FIG. 4 by the signal U, is obtained at the output of the inverter 37, while the output of the inverter 38 remains in the "0" state as shown by the signal D.

A like explanation would show that, if the spindle 1 is rotated in the opposite direction, i.e., the signal B' being in advance of the signal A', pulses will be obtained at the output of the inverter 38, the output of the inverter 37 then remaining in the "0" state.

Furthermore, the output of the flip-flop 40 remains in the same state as long as the correction pulses appear at the output connection of the same NOR gate 35 or 36. On the contrary, as soon as a pulse appears at the output of the other gate, i.e., as soon as the direction of rotation of the spindle 1 is changed, the output of the flip-flop 40 will change its state. The flip-flop 40 thus emits a signal S indicating the direction of rotation of the spindle.

One could provide only one output of the circuit 100 for the selection or correction pulses, the inputs of an OR gate (not shown in FIG. 3) then being connected to the outputs of the inverters 37 and 38.

The selection or correction signals, as well as the signal indicating the direction of rotation, which are produced in this manner may be transmitted as required to different counters, to a display control circuit or to a circuit which controls the operation of a stepping motor (not shown) of the watch, possibly simultaneously with the transmission of other signals produced by commutating means other than those described in the present specification.

Figure 5:
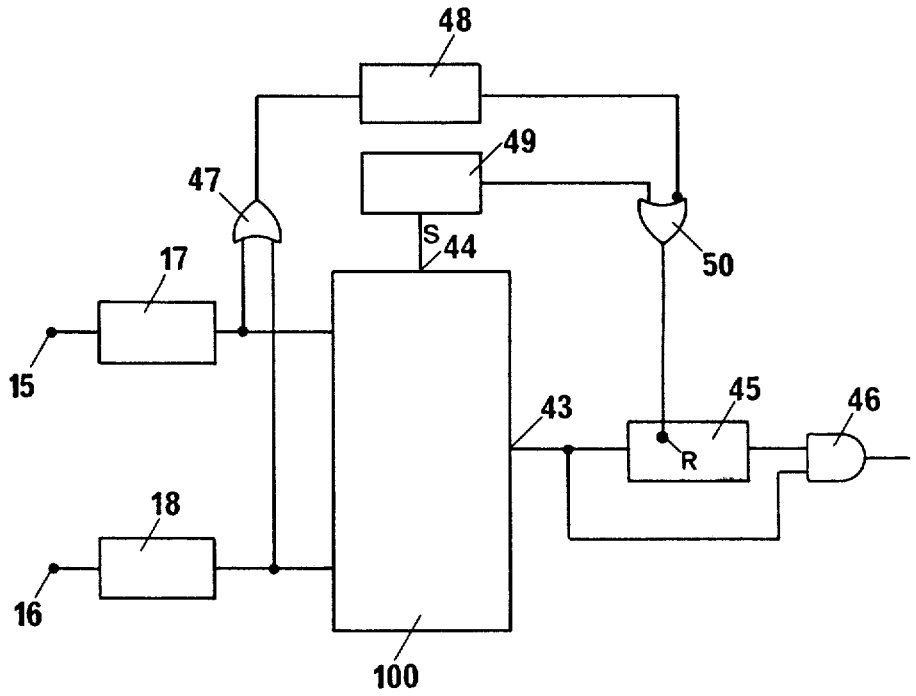
FIG. 5 is a circuit diagram showing one exemplary arrangement of a pulse-inhibiting means and of means for producing correction pulses and a signal of the direction of rotation of the spindle.

Nevertheless, in accordance with a novel feature of the invention, inhibiting means are provided in the preferred embodiment for preventing the passage of the first few pulses produced at the beginning of the rotation of the spindle in one direction or the other. Illustrative means of this type are shown in FIG. 5 in which the circuit 100 as well as the surge-suppression circuits of FIG. 3 are once again included and designated by the same reference numerals as before.

The circuit 100 in this case has only one output 43 for the selection or correction pulses and one output 44 for the signal S which indicates the direction of rotation of the spindle 1. The inhibiting means is constituted by a counter 45, the capacity of which corresponds to the number of pulses which it is desired should be prevented from being transmitted beyond it. For example, a counter which counts in threes would be suitable for use in conjunction with the commutating means 10 of FIG. 1. The output of the counter 45 is connected to one of the two inputs of an AND gate 46, the other input of which is connected directly to the output 43 of the circuit 100.

In addition, the outputs of the surge-suppression circuits 17 and 18 are connected to the inputs of an OR gate 47 the output of which is connected to the input of a monostable circuit 48, the output of which is connected to the inverting input of an OR gate 50. The other, non-inverting input of the gate 50 is connected to the output of a pulse edge detecting circuit 49 which receives at its input the signal S produced by the circuit 100. The output of the OR gate 50 is connected to the zero reset input R of the counter 45.

The novel illustrative arrangement shown in FIG. 5 operates as follows. When the spindle 1 is rotated in one direction, the circuit 100 produces selection or correction pulses which are transmitted to the counter 45 and to the gate 46. During the first two pulses, the output of the counter 45, which counts in threes, remains in the logical "0" state and the AND gate 46 remains closed. In response to the third pulse the output of the counter changes its state to "1" and remains in this state during the subsequent pulses which can thus pass through the AND gate 46, provided that on the one hand the spindle 1 continues to rotate in the same direction and that on the other hand rotation thereof is not discontinued for more than a given period of time. In this case, the output of the pulse edge detecting circuit 49 remains in the "0" state and that of the monostable 48, which has changed over to the "1" state of the arrival of the first commutating pulse emanating from one or other of the surge-suppression circuits 17, 18, is maintained in this "1" state by the subsequent pulses.

If, on the contrary, while the spindle 1 is being manipulated, the direction of rotation thereof is changed, the circuit 49 will produce a pulse which causes the counter to be reset to zero and thereby closes the AND gate 46. It is then necessary for the circuit 100 to produce three further pulses in order to effect the reopening of the AND gate 46. If rotation of the spindle 1 is discontinued for a period longer than that of the monostable 48, this likewise causes the counter 45 to be reset to zero. This arrangement thus makes it possible to prevent a change in the data displayed by the watch or an undesired correction of this data being brought about by any accidental or untoward rotation of the spindle 1.

In the case where the circuit 100 has two outputs for the selection or correction pulses, two identical arrangements of a counter and an AND gate are provided. The output of the OR gate 50 is then connected to the reset inputs of the two counters.

Various modifications may be made in the embodiment of the invention described above. For example, the angle between the minor axes of the cams 2 and 3 may be other than 45°. These cams may have a shape other than elliptical, for example, substantially polygonal so that a number of commutating pulses greater than two per cam per revolution of the spindle can be obtained. Those skilled in the art will understand that circuit 100 which produces the selection or correction pulses and the signal of the direction of rotation of the spindle 1 may also be replaced by any other circuit which is capable of producing similar signals.

While there are shown and described several preferred illustrative embodiments of the invention, it will be appreciated that other variations and modifications may be made within the principles of the invention and the scope of the appended claims.

What is claimed is:

1. Apparatus for the selection or the correction of data in an electronic watch provided with a rotatable spindle, the apparatus comprising commutation means operated by the rotation of the spindle in one direction or the other and arranged to produce two series of commutation pulses which are phase-displaced with respect to each other, the sign of the phase displacement depending on the direction of rotation of the spindle, and a circuit responsive to the series of commutation pulses to provide a signal indicating the direction of rotation of the spindle and to produce selection or correction pulses, the commutating means comprising two cams mechanically coupled to the rotatable spindle and angularly displaced one with respect to the other and two resiliently flexible strips of electrically conductive material each of which cooperates with a respective one of the cams and has one fixed end and one free end, the free end of each strip being alternately brought in contact with and moved away from a respectively fixed contact during the rotation of the spindle.

2. Apparatus according to claim 1, wherein the cams are of generally elliptical shape, centered on the axis of rotation of the spindle, and the major axes of the ellipses forming between them an angle such as to provide the series of pulses with a phase displacement sign dependent on direction of rotation.

3. Apparatus according to claim 2, wherein the major axes of the ellipses for between them an angle of approximately 45°.

4. Apparatus according to claim 1, 2 or 3, wherein the said circuit includes inhibiting means which render a predetermined number of selection or correction pulses ineffective at the beginning of the rotation of the spindle in one direction or the other.

5. Apparatus according to claim 4, wherein the inhibiting means comprise a counter the capacity of which corresponds to the number of pulses to be rendered ineffective.

6. Apparatus according to claim 5, comprising means arranged to reset the counter to zero when the spindle has not been operated for a given period of time.

7. Apparatus according to claim 5 or 6, comprising means arranged to reset the counter to zero when the direction of rotation of the spindle is changed.

* * * * *